United States Patent [19]

Burns

[11] Patent Number: 4,802,704

[45] Date of Patent: Feb. 7, 1989

[54] SPARE RIB HOLDER

[76] Inventor: Thomas P. Burns, 70 Oakridge La., Albertson, N.Y. 11507

[21] Appl. No.: 167,049

[22] Filed: Mar. 11, 1988

[51] Int. Cl.[4] ..... A47G 21/10; A47J 43/28

[52] U.S. Cl. ..... 294/99.2; 294/25; 294/106

[58] Field of Search ..... 294/106, 99.2, 3, 8.5, 294/11, 16, 25, 33; D7/76, 105; D1/102, 105; 30/147, 148, 149, 150; 128/321, 354

[56] References Cited

U.S. PATENT DOCUMENTS

| | | | |
|---|---|---|---|
| 3,259,415 | 7/1966 | Howard | 294/99.2 |
| 4,261,608 | 4/1981 | Bradshaw | 294/99.2 |

*Primary Examiner*—James B. Marbert

*Attorney, Agent, or Firm*—Howard Myles Schwinger

[57] ABSTRACT

A spare rib holder consisting of two oppositely disposed members pivotally joined at one end to simulate retractable jaws, the members being spring biased with respect to each other so as to normally be in open position, the free ends of both members being provided with oppositely disposed teeth for grasping a spare rib therebetween, the lower member having a ramp projecting forwardly therefrom for leading a spare rib to the jaws.

1 Claim, 1 Drawing Sheet

SPARE RIB HOLDER

This invention relates to a device for handling a spare rib while eating.

Although there have been proposals for grasping devices which may be used as an eating utensil such as corn holders, ice tongs, chop sticks and the like there are no devices which are uniquely adapted for eating spare ribs to spare a diner the usual messy hands associated with the handling of cooked spare ribs.

It is thus a primary object of the present invention to provide a device for the handling of spare ribs.

It is another important object of the present invention to provide a device of this nature which will be readily acceptable as table ware.

It is still a further object of this invention to provide such a device which is sturdy, attractive and relatively inexpensive to manufacture.

I realize these stated objectives by providing a spare rib holder comprising two oppositely disposed members pivotally joined at one end to simulate retractable jaws, said members being spring biased with respect to each other so as to normally be in open position, the free ends of both members being provided with oppositely disposed teeth for grasping a spare rib therebetween, the lower member having a ramp projecting forwardly therefrom for conducting a spare rib to jaws.

Other objects and advantages of the present invention will become apparent from a reading of the following specification taken in connection with the accompany drawing wherein.

Figure 1:
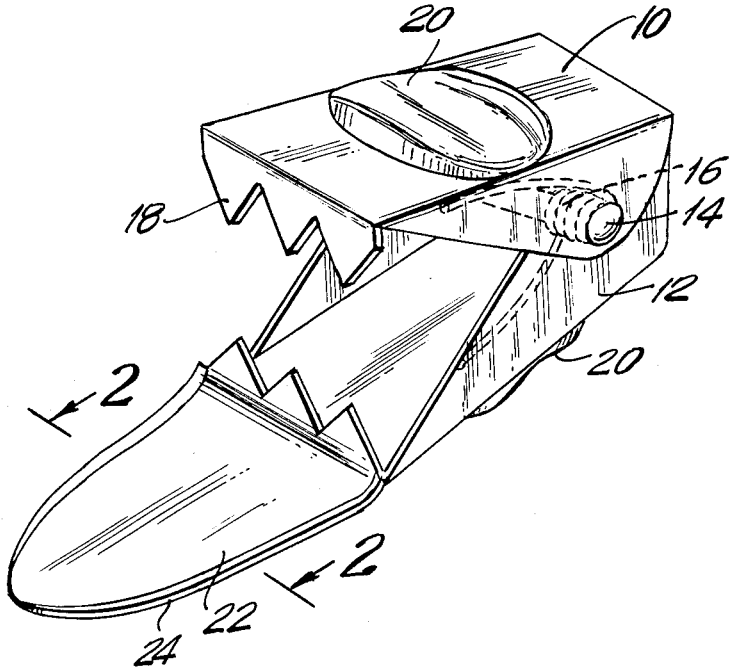
FIG. 1 is a perspective view of one embodiment of the present invention.
Figure 2:
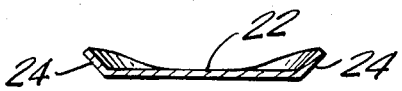
FIG. 2 is a sectional view taken on line 2—2 of FIG. 1 in the direction of the arrows.
Figure 3:
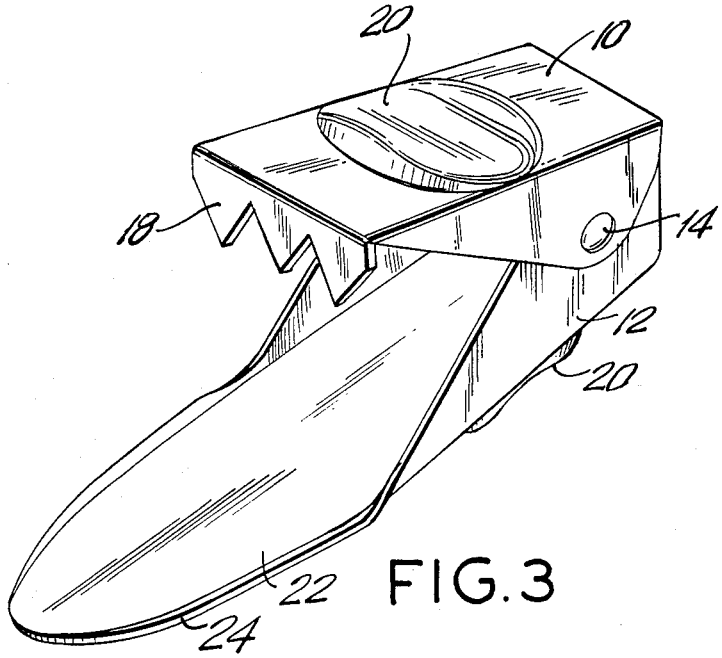
FIG. 3 is a perspective view of another embodiment of the invention.

Referring now to the drawing an embodiment of the present invention is shown in FIG. 1 consisting of oppositely disposed jaws 10 and 12 pivotally connected at one end thereof by bolt 14. Internally positioned coil spring 16 which is supported by bolt 14 normally holds the jaws apart in its relaxed state.

The free ends of the jaws are provided with teeth 18 for grasping. Plastic grips 20 are provided on the outer surfaces of the jaws so the device can be closed by the thumb and index finger of the user. It is closed simply by squeezing hard enough on grips 20 to overcome the resistance of spring 16. When the device is closed it will be noted that the teeth 18 of the upper jaw mesh with those of the lower jaw and that in this embodiment of the invention the lower jaw telescopes into the upper jaw when the jaws are closed.

Lower jaw 12 is provided with extension 22 for better manipulability. The extension is provided with side walls 24.

The device may be made of metal with the grips being of plastic and adhered to the metallic body.

It should be realized that the embodiment herein described is only representative of the invention and it is not intended to limit the invention to this particular embodiment as the invention encompasses all embodiments falling with the spirit and scope of the appended claims.

I claim:

1. A spare rib holder comprising two oppositely disposed members pivotally joined at one end to simulate retractable jaws, the lower member extending forwardly of the upper member, said members being spring biased with respect to each other so as to normally be in open position, the upper member being provided with a row of teeth at its free end, said teeth extending transversely of the holder; the lower member having a forwardly projecting uninterrupted scoop for accessing a spare rib, the scoop being provided with a retaining wall at its sides, a spare rib being clampable between the teeth and the scoop after being accessed by the scoop, the outer surfaces of both members being provided with finger grips so the device may be conveniently held between the thumb and index finger and squeezed closed thereby.

* * * * *